United States Patent [19]

Forberg

[11] 4,279,460

[45] Jul. 21, 1981

[54] ELECTRICAL CRIMP CONNECTOR FOR MAKING A CONNECTION BETWEEN AN INSULATED WIRE AND CONNECTING ELEMENT

[75] Inventor: Horst Forberg, Berlin, Fed. Rep. of Germany

[73] Assignee: Krone GmbH, Berlin, Fed. Rep. of Germany

[21] Appl. No.: 23,755

[22] Filed: Mar. 26, 1979

[30] Foreign Application Priority Data

Mar. 30, 1978 [DE] Fed. Rep. of Germany ..... 2814069

[51] Int. Cl.[3] ..... H01R 11/20

[52] U.S. Cl. ..... 339/97 P

[58] Field of Search ..... 339/96, 97, 98, 99

[56] References Cited

U.S. PATENT DOCUMENTS

| | | | |
|---|---|---|---|
| 2,694,189 | 11/1954 | Wirsching | 339/97 R |
| 3,702,456 | 11/1972 | Patton | 339/98 X |
| 4,013,332 | 3/1977 | Dauser | 339/98 |
| 4,066,317 | 1/1978 | Bierenfeld | 339/98 X |
| 4,136,920 | 1/1979 | Scholtholt | 339/98 |
| 4,171,857 | 10/1979 | Forberg et al. | 339/97 P |

*Primary Examiner*—John McQuade
*Assistant Examiner*—John S. Brown
*Attorney, Agent, or Firm*—Weingarten, Maxham & Schurgin

[57] ABSTRACT

An electrical crimp connector for making a connection between an insulated wire and a connecting element. The connecting element comprises two limbs which define a slot into which the wire can be inserted, the dimensions of the slot being such that the insulation of the wire is cut. The connector has a clamping element on which the connecting element is secured at an angle of approximately 45°. A plurality of connecting elements connected in pairs are housed in a number of interconnected clamping elements and formed into a unit. The connecting elements are connected by a transverse web and are pluggable into the clamping element, separate external wire-rod guides for the incoming and outgoing conductors are formed on the clamping element and the clamping element has a smooth bottom surface.

10 Claims, 6 Drawing Figures

ELECTRICAL CRIMP CONNECTOR FOR MAKING A CONNECTION BETWEEN AN INSULATED WIRE AND CONNECTING ELEMENT

DESCRIPTION

The invention relates to an electric crimp connector between an insulated wire and a connecting element having two limbs and made of flat strips of resilient contact material having a slot at the center of the flat part, the main part of the slot being adjacent a widened insertion opening and surrounded by sharp edges and having a width which is less than the thickness of the metal wire core, so that when the wire is inserted into the slot the wire insulation is cut through and a contact connection is formed between the wire and the connecting element in co-operation with a clamping element associated with the connecting element and used for gripping the insulated wire. According to a feature of the crimp connector the clamping element, which has a vertically downward slot at the centre of its rectangular cross-section, is constructed as an insulator and the connecting element is permanently secured at an angle of approximately 45° on the bearing surface of the clamping element, and the clamping element surrounds or encloses the connecting element and a number of such connecting elements connected in pairs are surrounded by a number of interconnected clamping elements and combined into a structural unit provided with wire-rod guides, and the clamping elements are pluggable. This type of connector is also described in copending U.S. application No. 908,937, now U.S. Pat. No. 4,171,857.

The invention relates to an improvement of the crimp connector. The invention is based on the problem of simplifying the construction.

According to the present invention there is provided an electric crimp connector between an insulated wire and a connecting element having two limbs and made of flat strips of resilient contact material having a slot at the centre of the flat part, the main part of the slot being adjacent a widened insertion opening and surrounded by sharp edges and having a width which is less than the thickness of the metal wire core, so that when the wire is inserted into the slot the wire insulation is cut through and a contact connection is formed between the wire and the connecting element in co-operation with a clamping element associated with the connecting element and used for gripping the insulated wire. The clamping element, which has a vertically downward slot at the centre of its rectangular cross-section, is constructed as an insulator and the connecting element is permanently secured at an angle of approximately 45° on the bearing surface of the clamping element, and the clamping element surrounds or encloses the connecting element and a number of such connecting elements connected in pairs are surrounded by a number of interconnected clamping elements and combined into a structural unit provided with wire-rod guides, and the clamping elements are pluggable wherein a number of connecting elements connected by a transverse web are pluggable into the insulator, separate external wire-rod guides for the incoming and outgoing cable cores or wires are formed on the insulator, and the insulator terminates at the bottom in a smooth surface.

According to the prior art construction, the connecting elements are mainly secured by a multipin connector in a separate bearing plate, whereas the separate bearing plate is omitted in the present invention.

Advantageous further embodiments of the individual features of the invention are described in the sub-claims.

An embodiment of the invention will be described now by way of example only with particular reference to the accompanying drawings, in which.

Figure 1:
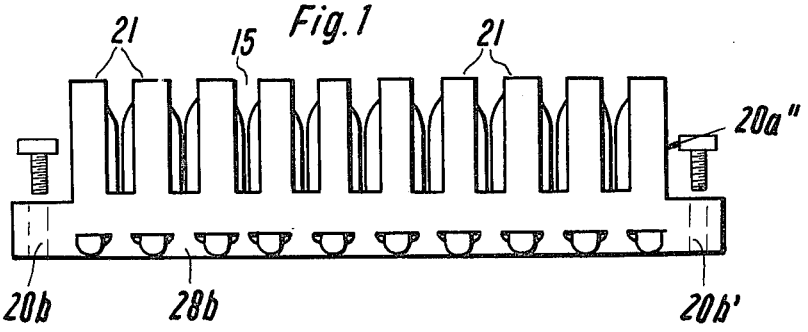
FIG. 1 shows another embodiment of a terminal strip made up of a number of crimp connectors, in side view on the insulator, which forms the housing.
Figure 2:
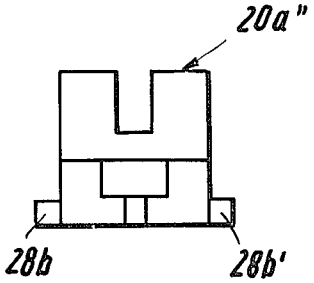
FIG. 2 shows the terminal strip according to FIG. 1 in plan view at one end.
Figure 3:
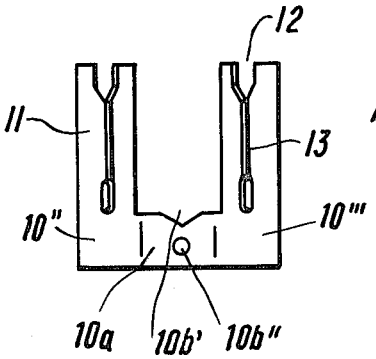
FIG. 3 is a view of the connecting elements interconnected by a transverse web.
Figure 3A:
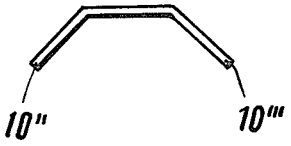
Figure 4:
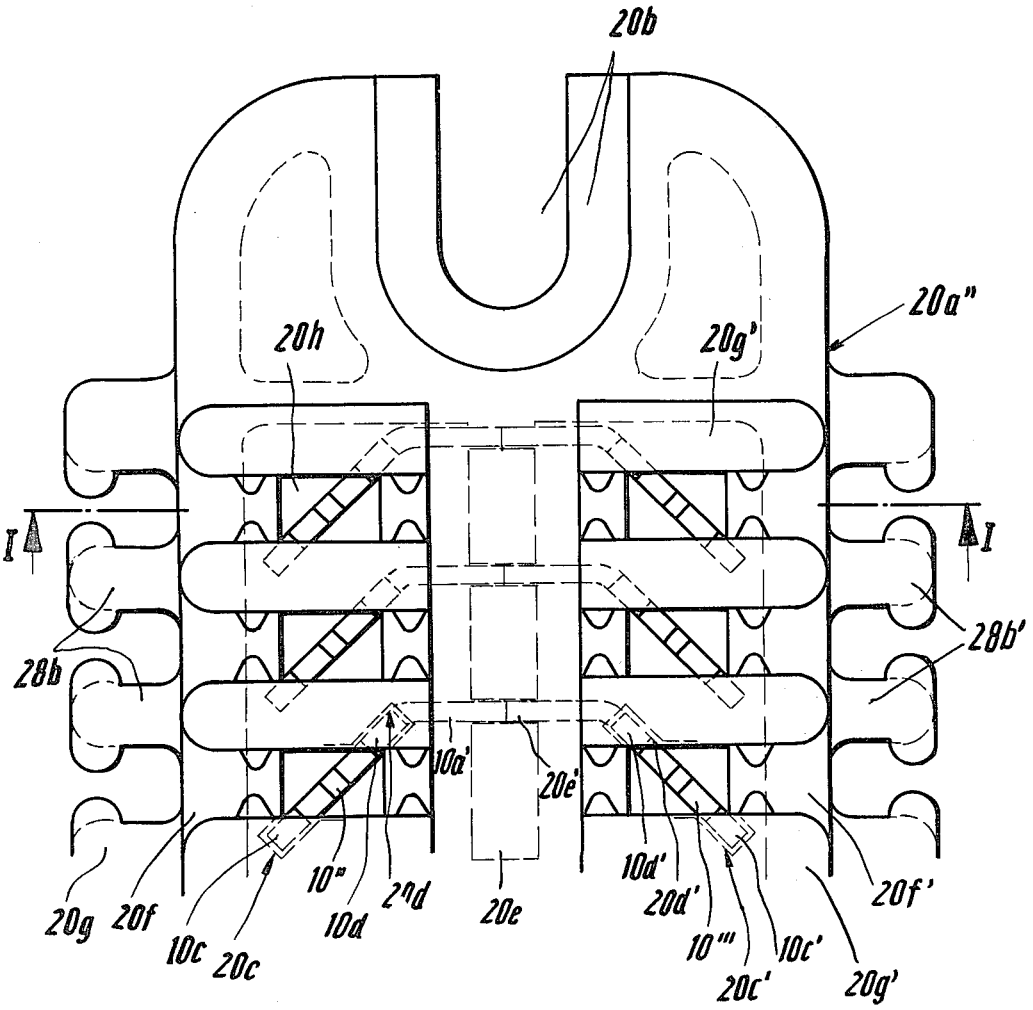
Figure 5:
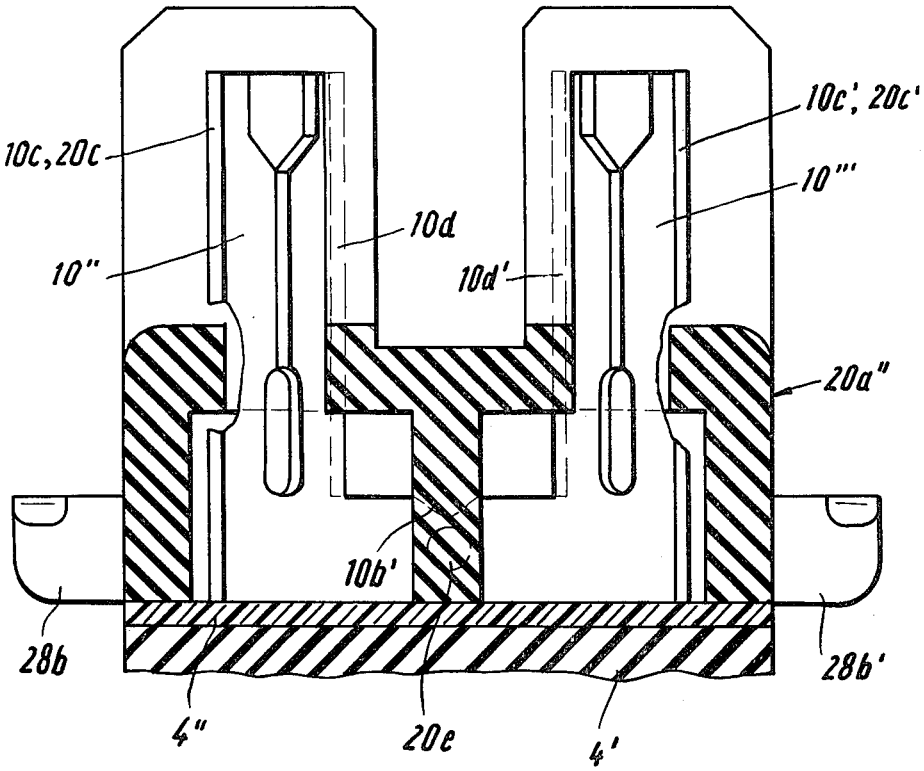

FIG. 3*a* is a plan view of the connecting elements in FIG. 3;

FIG. 4 is a partial plan view of the insulating member of the terminal strip, illustrating how the crimp connector in FIGS. 3 and 3*a* is plugged into three of the chambers of the insulator in FIGS. 1 and 2, and FIG. 5 is a cross-section of the simplified crimp connector along line I—I in FIG. 4.

The invention as shown in FIGS. 3 and 3*a*, provides a number of connecting elements 10″, 10‴ connected at the bottom by a transverse web 10*a* ′. As shown more particularly in FIGS. 4 and 5, the connecting elements can be plugged from the bottom into the insulator 20*a* ‴ which is comprised of a plurality of clamping elements 21. As shown in FIGS. 1 and 2, the insulator 20*a*‴ is formed with separate external wire-rod guides for the incoming and outgoing cable cores or wires (not shown).

Another important feature is that the insulator can terminate in a flat surface at the bottom (FIGS. 1 and 2).

In the special embodiment shown in FIGS. 3, 3*a* and 4, the connecting elements 10″, 10‴ are bent, preferably in a U-shape, at the ends of the transverse web 10*a*′Connecting elements 10″, 10‴, preferably each include a slot 11 having an upwardly facing opening 12 which is wider than the diameter of an insulated wire to be inserted therein. Slot 11 may also include an elongated central portion 13 having a width less than the thickness of the metal wire core of an insulated wire so that when the wire is inserted into slot 11 the insulation of the wire is cut and an electrical contact is made between the metal wire core and the connecting element 10″, 10‴ and so that the insulated wire is properly gripped. The slot 11 further includes a lower elongated portion having a width somewhat greater than that of portion 13 and which is adapted to accommodate a wire inserted therein. Typically, slot 11 is disposed at the transverse center of connecting elements 10″, 10‴ and is vertically disposed therein.

According to another feature, in order to simplify the manner of securing the connecting elements in the insulator, the transverse web 10*a*′ has a central cut-out portion 10*b*′ and a protrusion or recess 10*b*″ which fit by clamping into a slot 20*e*′ in a guide web 20*e* extending at the bottom and longitudinally in the insulator 20*a*″. These features relate to the manner of securing the double terminal in the bottom part of insulator 20*a*″.

An equally simple retaining means is also provided in the top part of insulator 20*a*″. The means is as follows: each double terminal 10″, 10‴, 10*a*′ is disposed in a chamber, e.g. 20*h*, bounded by side walls 20*f*, 20*f*′ and transverse walls 20*g*, 20*g*′ in insulator 20*a*″, the side and transverse walls having upwardly extending slots 20*c*, 20*d* into which the outer and inner edges 10*c*, 10*d* of the connecting elements 10'', 10''' can be plugged (FIGS. 4 and 5). An upwardly facing slot 15 for the insertion of an insulated wire is disposed generally at the center of the rectangular cross section of each clamping element 21.

According to another feature, a securing device 20*b*, 20*b*' is formed on the end faces of the insulator 20*a*'' at the bottom on each side (FIGS. 1, 2 and 4).

Of course, the securing device is flush at the bottom with the bottom edge of the insulator (FIGS. 1 and 2).

The securing device 20*b*, 20*b*' is preferably a screw connection (FIGS. 1, 2 and 4).

In conjunction with the aforementioned features, the bottom of the insulator 20*a*'' can directly be placed on a smooth surface 4' e.g. the bottom of a telecommunications device.

If this condition is not fulfilled, the bottom of the insulator 20*a*'' is covered by a plate 4'' having high electrical insulation.

According to a final feature, the wire-rod guides 28*b*, 28*b*' are formed on the insulator 20*a*'' on both sides at the bottom edge of its side walls 20*f*, 20*f*' (FIGS. 1, 2 and 5).

I claim:

1. An electrical crimp connector for an insulated wire comprising:

an insulator formed of a plurality of interconnected insulating clamping elements and having a top portion and a smooth bottom surface, each of said clamping elements having a slot extending from said top portion towards the bottom surface;

a plurality of pairs of connecting elements, each pair of connecting elements being pluggable into a chamber in one of said clamping elements from said bottom surface of said insulator and being individually retainable therein, each pair of connecting elements being interconnected by a transverse web, each of said connecting elements including a flat portion formed of a resilient, electrically conductive material and disposed at an angle of 45° with respect to said clamping element slot, and a slot disposed at the transverse center of said flat portion in communication with said clamping element slot, said connecting element slot having a widened opening facing said top portion of said clamping element and a lower portion having a width narrower than said opening and narrower than the width of the metal core of an insulated wire, said lower portion having sharp edges adapted to cut insulation on an insulated wire and to contact the metal core of an insulated wire; and wire rod guides associated with each of said clamping elements.

2. A device as claimed in claim 1 wherein each pair of connecting elements is bent preferably in a U shape at the ends of their interconnecting transverse web.

3. A device according to claim 1 or 2 wherein each transverse web has a central cut-out portion and a protrusion or recess which fits by clamping into a slot in a guide web extending along the bottom surface longitudinally of the insulator.

4. A device according to claim 3 wherein each pair of connecting elements is disposed in a chamber bounded by side walls and transverse walls of said insulator, the side and transverse walls having upwardly extending slots into which lateral edges of the flat portions of said connecting elements can be plugged.

5. A device according to claim 4 wherein a securing device is formed on the end faces of said insulator adjacent said bottom surface.

6. A device according to claim 5 wherein said securing device is preferably adapted for receiving a screw connection.

7. A device according to claim 6 wherein said bottom surface of the insulator can directly be placed on a smooth surface e.g. the bottom of a telecommunications device.

8. A device according to claim 6 wherein said bottom surface of the insulator is covered by a plate having high electrical insulation.

9. A device according to claim 1 wherein wire rod guides are formed on the insulator on both sides thereof at the bottom edge of its side walls.

10. An electrical crimp connector for an insulated wire comprising:

an insulator formed of a plurality of interconnected clamping elements and having a top portion and a smooth bottom surface, each of said clamping elements having a slot extending from said top portion towards the bottom surface;

a plurality of pairs of connecting elements, each pair of connecting elements being pluggable into one of said clamping elements from the bottom surface of the insulator to extend upwardly toward an associated clamping element slot, each of said connecting elements including a flat portion formed of a resilient, electrically conductive material and disposed at an angle of 45° with respect to said associated clamping element slot;

a plurality of transverse webs, one transverse web interconnecting each pair of connecting elements;

a guide web disposed along said bottom surface longitudinally of said insulator and having slots disposed therein; and means disposed on each of said transverse webs adapted to engage one of said guide web slots for securing said transverse web to said guide web.

* * * * *